United States Patent [19]

U Park

[11] Patent Number: 5,044,517

[45] Date of Patent: Sep. 3, 1991

[54] AUTOMATIC VENDING MACHINE HAVING CUP DISPENSER WITH AUXILIARY CUP LOADING RACK AND CONTROL CIRCUIT THEREFOR

[75] Inventor: Kwon U Park, Seoul, Rep. of Korea

[73] Assignee: Samsung Electronics Co., Ltd., Rep. of Korea

[21] Appl. No.: 436,329

[22] Filed: Nov. 14, 1989

[30] Foreign Application Priority Data

Nov. 14, 1988 [KR] Rep. of Korea ..... 88-14946

[51] Int. Cl.[5] ..... G07F 11/12

[52] U.S. Cl. ..... 221/11; 221/17; 221/104; 221/105

[58] Field of Search ..... 221/11, 10, 17, 103, 221/104, 105, 113, 119, 121, 122

[56] References Cited

U.S. PATENT DOCUMENTS 2,742,183 4/1956 Strempel ..... 221/17 X 4,480,764 11/1984 Takagi et al. ..... 221/11

*Primary Examiner*—David H. Bollinger

*Attorney, Agent, or Firm*—Sterne, Kessler, Goldstein & Fox

[57] ABSTRACT

The invention is directed to a cup dispenser having an auxiliary cup loading rack for an automatic vending machine. A control circuit enables selective feeding of different drink cup types from said auxiliary loading rack. The disclosed invention is capable of feeding more hot or cold drink cups according to seasonal demands, for example, thereby avoiding lost sales due to a shortage of a more frequently used cup type.

2 Claims, 5 Drawing Sheets

AUTOMATIC VENDING MACHINE HAVING CUP DISPENSER WITH AUXILIARY CUP LOADING RACK AND CONTROL CIRCUIT THEREFOR

BACKGROUND OF THE INVENTION

1. Field of the Invention

The present invention relates to a cup dispenser for an automatic vending machine which is loaded with cold drink cups and hot drink cups. The cups differ from each other in their dimensions. The dispenser selectively drops either the loaded cold drink cup or hot drink cup in response to the purchase demand for either the cold drink or hot drink. Specifically, the invention relates to a cup dispenser having an auxiliary cup loading rack for an automatic vending machine; its control circuit is capable of feeding more drink cups by forming an auxiliary cup loading rack within the cup dispenser.

2. Description of the Related Art

According to the conventional cup dispenser, as shown in FIG. 1, cold drink cup loading means 4 and hot drink cup loading means 5 are formed with door 1, guide 2 and frame 3; turrets 6 and 7 for cold drink cups and hot drink cups, respectively, are fixed with turret plates 6B–6E, 7B–7E at rotary shafts 6A and 7A, and are mounted within the cup loading means 4 and 5, respectively. Dropping outlet holes 8 and 9 are for dropping the cups and are respectively formed on the bottom surfaces of cup loading means 4 and 5.

As shown in FIG. 2, cup detecting switches SW8 and SW9 are associated with cup dropping outlet holes 8 and 9. The switch contacts close when the hot or cold cups are not located on the dropping outlet holes 8 and 9. Switches SW8 and SW9 control turret motors M6 and M7 for rotating the feeding turrets 6 and 7, respectively. The switches are connected between the power supply terminals A1 and B1. Power supply source AC is connected to terminals A1 and B1 to control the operation of the cup dispenser.

According to the conventional cup dispenser and its control circuit constituted as aforementioned, when carrying out the operation in a state that a cold drink cup and a hot drink cup are respectively loaded between each set of turret plates (6B, 6C) (6C, 6D) (6D, 6E), (7B, 7C) (7C, 7D) (7D, 7E), at the same time, the cold drink cup and the hot drink cup are loaded on the dropping outlet holes 8 and 9 between the turret plates (6A, 6B), (7A, 7B). A cold drink cup or a hot drink cup is loaded on the dropping outlet holes 8 or 9 in preparation to be selectively dropped in response to a purchaser's demand for a cold drink or a hot drink.

In such a state when the dropping of the cold drink cup loaded on the dropping outlet hole 8 is completed, the dropping outlet cup detecting switch SW8 becomes closed indicating that the cold drink cup is no longer loaded on the dropping outlet 8. The turret motor M6 is driven to rotate the feeding turret 6. The cold drink cup loaded between the turret plates 6B, 6C is then moved to the dropping outlet 8, and the dropping outlet cup detecting switch SW8 is opened to stop driving the turret motor M6.

When the dropping of the hot drink cup loaded on the dropping outlet 9 is completed as discussed above, the dropping outlet cup detecting switch SW9 becomes closed, and the turret motor M7 is driven to position the hot drink cups loaded between the turret plates (7B, 7C), (7C, 7D), (7D, 7E). The hot drink cups are sequentially moved to the dropping outlet 9 and are dropped.

The conventional cup dispenser and its control circuit as aforementioned is limited in the quantity of the cold drink cups and hot drink cups that are available to load. When the cold drink is more frequently sold, as in summer, further cold drinks do not sell due to the shortage of cups, while the hot cups remain idle. In the case when hot drinks are sold more frequently, as in winter, further hot drinks cannot be sold due to the shortage of hot drink cups and the cold cups remain idle.

SUMMARY OF THE INVENTION

The present invention provides a cup dispenser and its control circuit which can supply many more of the drink cups being sold due to seasonal demand, thus avoiding lost sales due to cup shortages.

This object of the cup dispenser and its control of the present invention avoids cup shortages by using an auxiliary cup loading rack between the cold drink cup loading means and the hot drink cup loading means of the cup dispenser. The present invention loads cold drink cups on the auxiliary cup loading rack when the cold drink is sold more often. When the dropping of the cold drink cups loaded on the dropping outlet of the cold drink cup loading means is completed, cups are dropped by moving the cold drink cups loaded on the auxiliary cup loading rack to the cold drink cup dropping outlet. Loading of the hot drink cups on the auxiliary cup loading rack is initiated when the hot drinks are more frequently sold. When the supply of hot drink cups loaded on the dropping outlet of the hot drink cup loading means is completed, hot drink cups are dropped by moving the hot drink cups loaded on the auxiliary cup loading rack to the hot drink cup dropping outlet.

The foregoing and other advantages of the present invention will become clear by the following description of the invention with reference to the accompanying drawings.

BRIEF DESCRIPTION OF THE DRAWINGS

For a better understanding of the invention, and to show how the same may be carried out, reference will now be made, by way of example, to the accompanying drawings, in which.

Throughout the drawings, like reference numerals and symbols are used for designating like or equivalent parts or portions, for simplicity of illustration and explanation.

DETAILED DESCRIPTION OF THE INVENTION

The cup dispenser and its control circuit of the present invention, having the advantages as aforementioned, will be described in detail with reference to the accompanying FIGS. 3 to 6.

Figure 1:
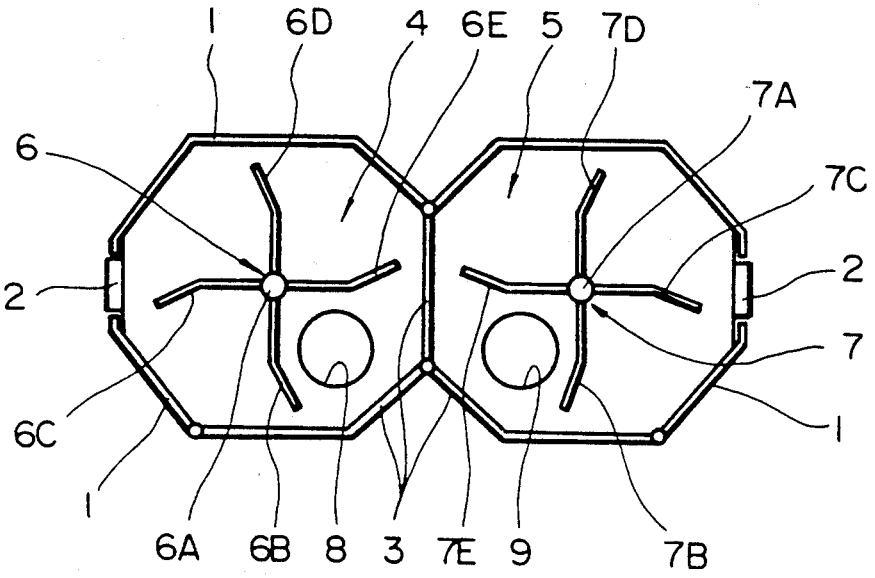
FIG. 1 PRIOR ART
FIG. 1 is a schematic plan view showing the conventional cup dispenser.
Figure 2:
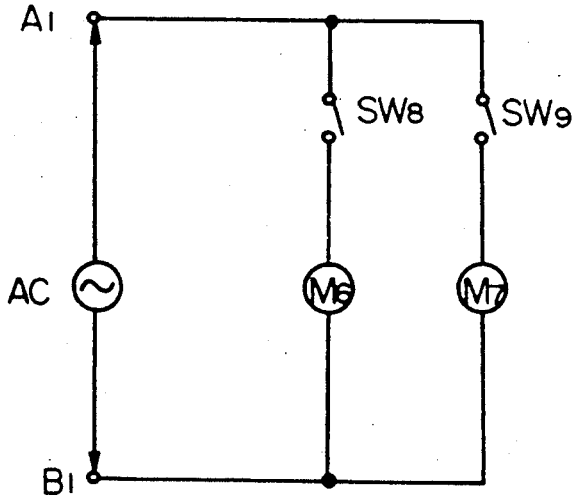
FIG. 2 PRIOR ART
FIG. 2 is a circuit diagram of the conventional cup dispenser.
Figure 3:
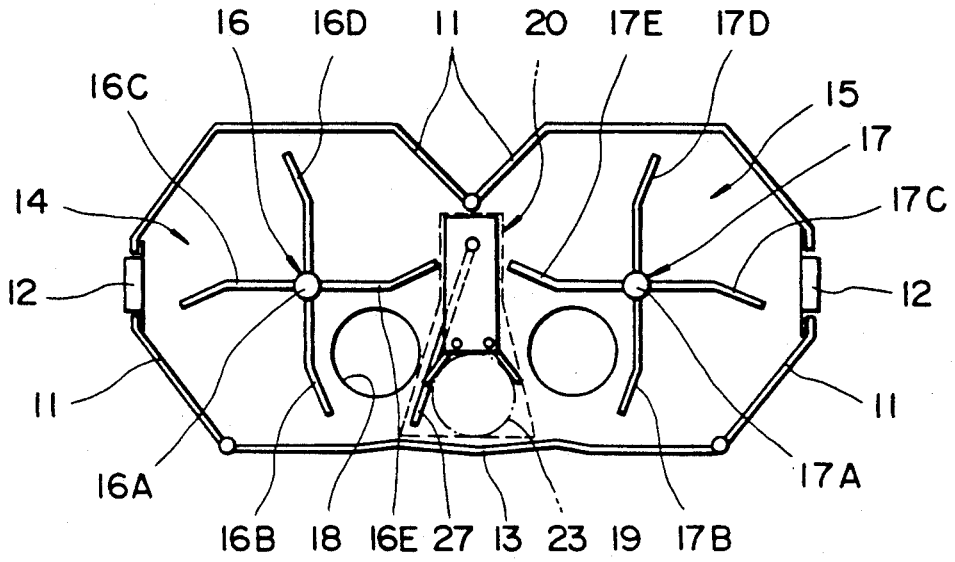
FIG. 3 is a schematic plan view showing a cup dispenser having an auxiliary cup loading rack of the present invention.

FIG. 3 is a schematic plan view showing the cup dispenser having an auxiliary cup loading rack of the present invention. The cup dispenser comprises a cold drink cup loading means 14, a hot drink cup loading means 15, door 11, guide 12 and frame 13. Turrets 16 and 17 are for feeding the cold drink cups and hot drink cups. Turret plates 16B–16E, 17B–17E are fixed to the rotary shaft 16A, 17A and are mounted within the cup loading means 14, 15 respectively. The dropping outlets 18 and 19 are for dropping the cups and are formed on the bottom surface of the cup loading means 14, 15. An auxiliary cup loading rack 20 is loaded selectively with the cold drink cups or hot drink cups and is positioned between the cold drink cup loading means 14 and hot drink cup loading means 15.

Figure 5:
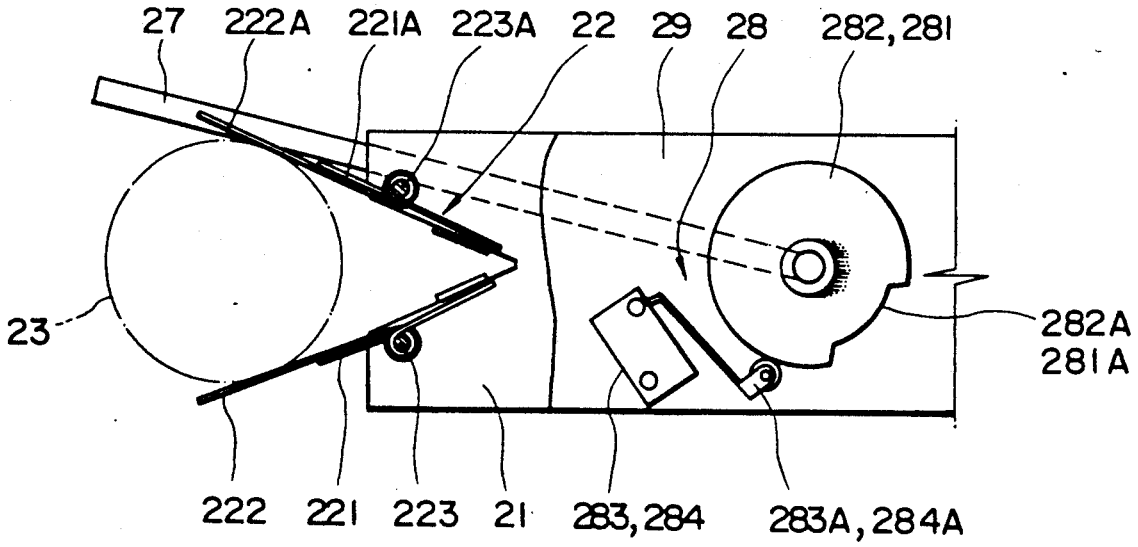
FIG. 5 is a schematic plan view illustrating the essential portion of the auxiliary cup loading rack of the present invention.
Figure 4:
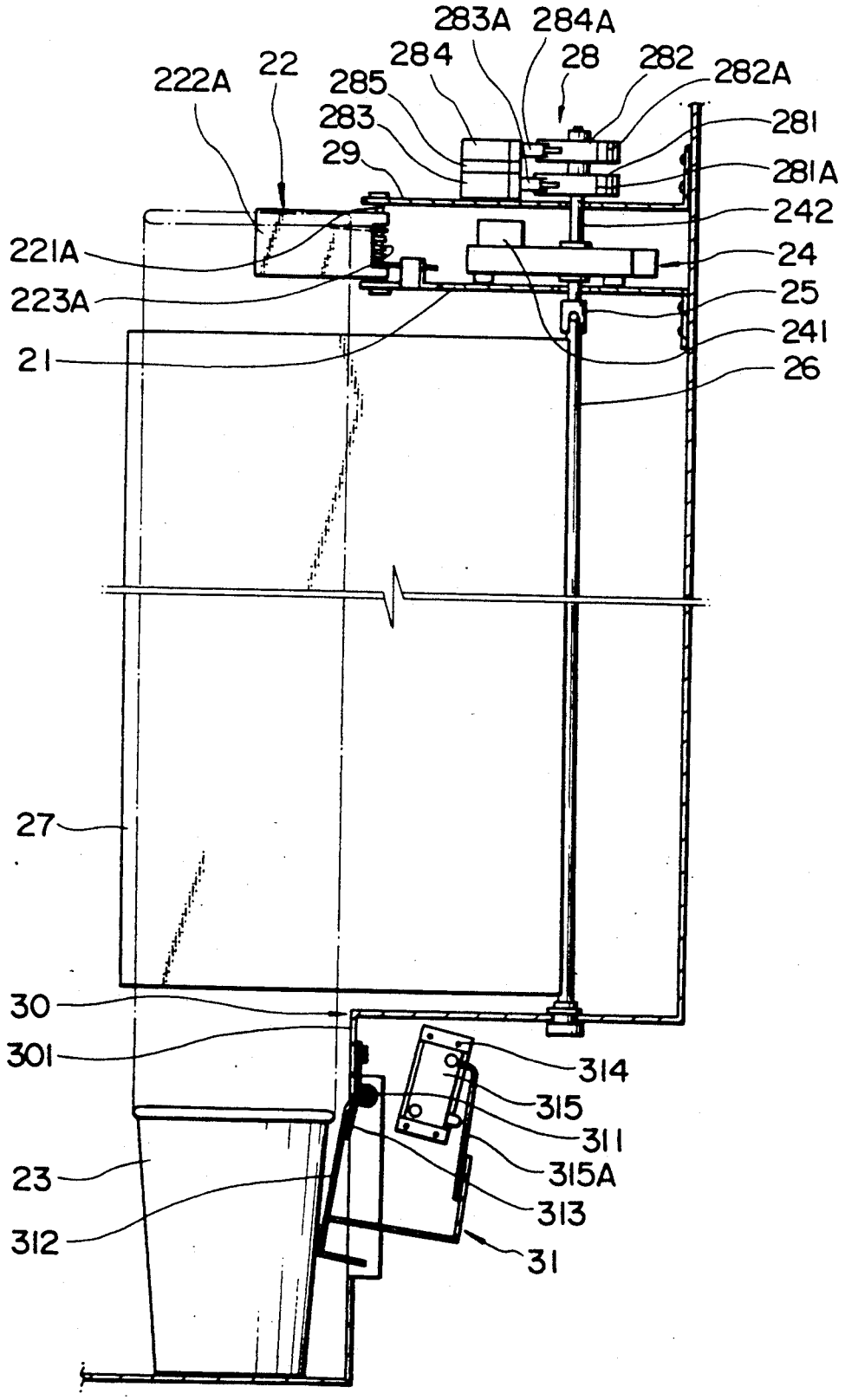
FIG. 4 is a cross sectional view taken from the side showing the auxiliary cup loading rack of the present invention.
Figure 4A:
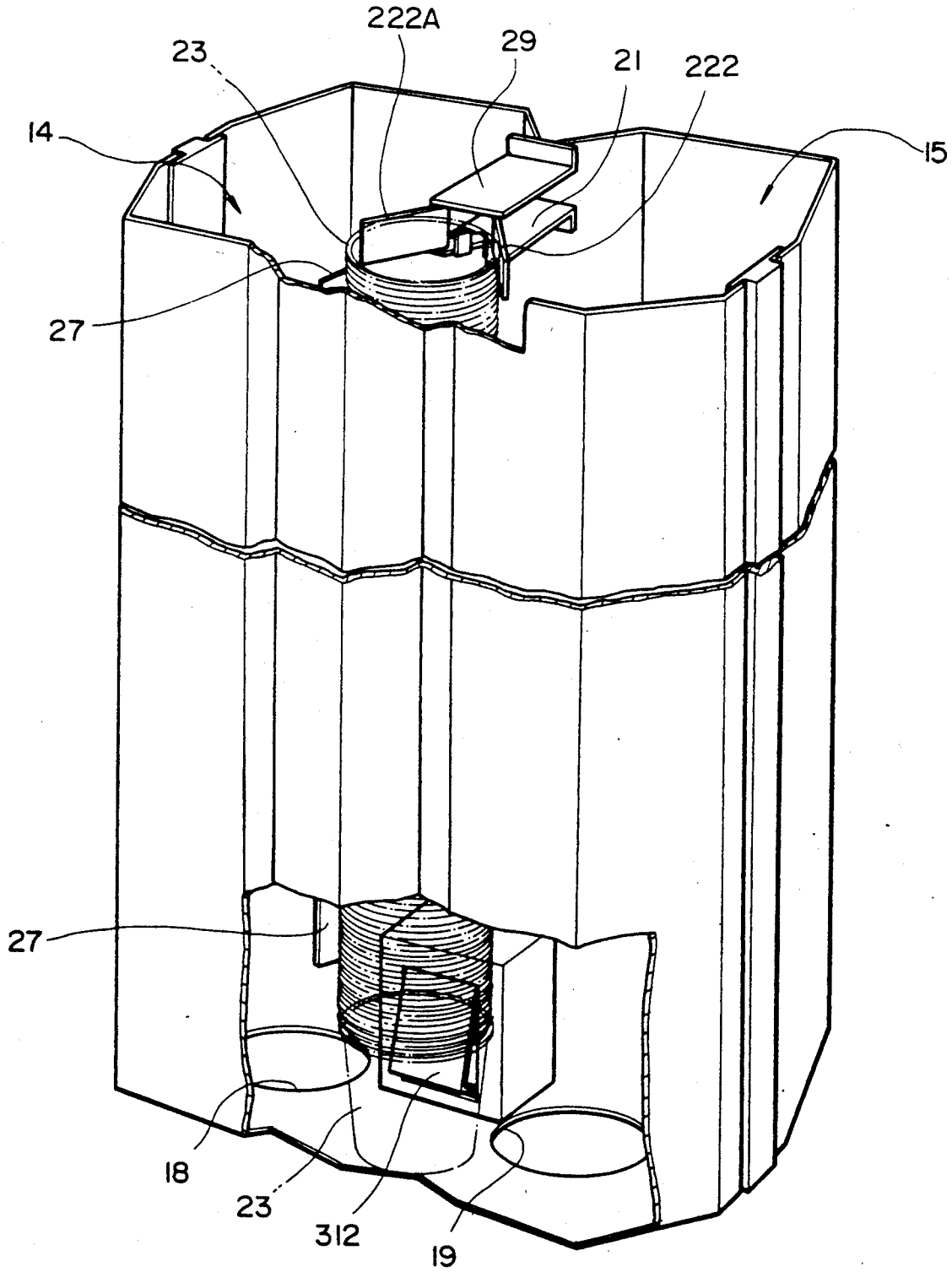
FIG. 4A is a perspective diagram of the auxiliary cup loading rack.

FIG. 4 is a side view partly showing a cross sectional for illustrating the auxiliary cup loading rack 20 of the present invention. A diagrammatic perspective view of the auxiliary cup loading rack 20 is shown in FIG. 4A. FIG. 5 is a schematic plan view of the auxiliary cup loading rack. Here, numeral 21 is an upper fixing plate, and numeral 22 is supporting means for preventing the auxiliary cup 23 from falling down.

Supporting means 22 is fixed with pivot pins 221 and 221A located at both sides of the front of the upper fixing plate 21. Supporting plates 222, 222A are inserted to the pivot pins 221, 221A respectively. At the same time, springs 223, 223A are urged inwardly so that the supporting plates 222, 222A support loaded auxiliary cup 23.

Returning again to FIGS. 4 and 4A, numeral 24 is a gear box fixed to the top surfaces of the upper fixing plate 21. Direct current motor 241 is designed for moving the cup and is contained within the gear box 24. Rotary shaft 242 is rotated according to the driving of the direct current motor 241 for cup moving. The rotary shaft 242 is extended to the lower portion of fixing plate 21. Turning shaft 26 is connected to the bottom 30 of extended rotary shaft 242 by the coupling means 25. Moving plate 27 is fixed to turning shaft 26 and plate 27 is turned to the right or left according to the driving of the direct current motor 241 to move the auxiliary cup 23 toward the one of the dropping outlets 18 or 19.

Numeral 28 is a detecting means of the auxiliary cup loading rack for detecting whether the auxiliary cup 23 is moved to one of the dropping outlets 18 or 19, according to the turning of moving plate 27. The auxiliary cup moving completion detecting means 28 is constituted such that the rotary shaft 242 is extended to the upper portion of the top cover plate 29. Cams 281 and 282 are formed with recesses 281A and 282A on the circumference and are fixed to the extended rotary shaft 242. Moving state detecting microswitches 283 and 284 are fixed on the top surface of top cover plate 29. A spacer 285 maintains a predetermined distance so that levers 283A, 284A are contacted respectively to cams 281, 282. Microswitches 283 and 284 are closed when the moving plate 27 moves the auxiliary cup 23 according to the driving of the direct current motor 241. The microswitches 283 and 284 are initially opened when the auxiliary cup 23 has not been moved, and also when the moving is completed.

A frame 30 mounts the several elements and numeral 31. An auxiliary cup load detecting means 31 detects whether the auxiliary cup 23 is loaded.

The auxiliary cup load detecting means 31 is constituted such that pivot pin 311 is mounted at the vertical portion 301 of the frame 30. Lever 312 is mounted to pivot pin 311, and spring 313 is provided for the direction of loaded auxiliary cup 23. Fixing means 314 is fixed to a side wall of the frame 30. Microswitch 315 is for the detection of auxiliary cup loading and is attached to the fixing means 314. When the auxiliary cup 23 is not loaded, lever 312 is urged frontward by the spring 313 and the lever 315A of microswitch 315 is pulled so that the microswitch contacts become opened.

Figure 6:
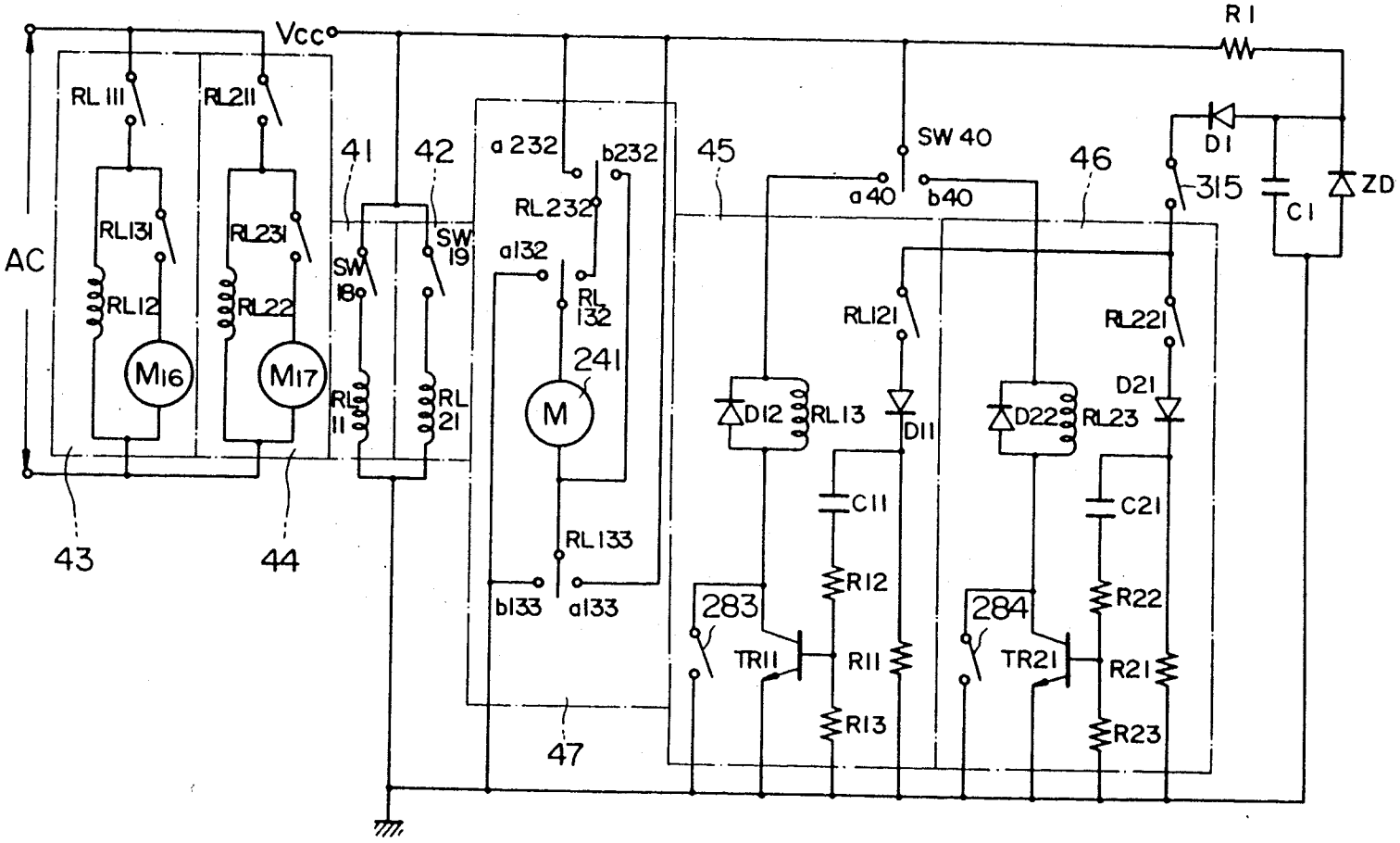
FIG. 6 is a circuit diagram of the control circuit of the cup dispenser of the present invention.

FIG. 6 is a circuit diagram of the control circuit of the cup dispenser according to the present invention. The control circuit comprises dropping outlet detecting means 41, 42 with dropping outlet detecting switches SW18 and SW19, respectively. The switches detect whether a cold drink cup or a hot drink cup are loaded on the dropping outlets 18, 19. RL11, RL21 are relays connected in series with switches SW18 and SW19, respectively.

Turret driving and auxiliary cup feeding control means (43 and 44, respectively) comprise relay switches RL111, RL131, RL211, RL231; relays RL12, RL22; and turret motors M16, M17 move turrets 16, 17, respectively, by control of dropping outlet detecting means 41 and 42.

Turret driving control and auxiliary cup feeding driving means 45 and 46 comprise relay switches RL121, RL221; diodes D11, D12, D21, D22; resistors R11–R13, R21–R23; capacitors C11, C21; transistors TR11, TR21; relays RL13, RL23; and microswitches 283, 284 which stop the driving of turrets 16 and 17 according to the control of turret driving and auxiliary cup feed control means 43 and 44. This control is initiated when the auxiliary cup 23 is loaded and the microswitch 315 is closed, at the same time, to feed the auxiliary cup 23 to respective dropping outlets 18 and 19.

Selection switch SW40 controls turret driving control and auxiliary cup feed driving means 45 and 46, respectively.

Auxiliary cup moving means 47 comprises relay switches RL132, RL133, RL232 and cup moving direct current motor 241. Motor 241 moves the auxiliary cup 23 toward the dropping outlets 18 and 19 by the control of turret driving control and auxiliary cup feed driving means 45 and 46 respectively.

RL111, RL211, RL121, RL221, RL133, RL231, RL232 are relay switches. RL11, RL21, RL12, RL22, RL13, RL32, are relays associated with the aforementioned relay switches, respectively. Relay switches RL111, RL211, RL121, RL221 are closed when the relays RL11, RL21, RL12 and RL22, respectively, are driven. The movable terminals of the relay switches RL132 and RL232 contact the fixed terminals a132 and a232, respectively, when relay RL13 is driven. The movable terminal of relay switch RL133 contacts fixed terminal a133 when relay RL23 is driven. Relay switches RL131, RL231 are closed when relays RL13, RL23, respectively, are not driven. At the same time (when relays RL13 and RL23 are not driven), the movable terminals of relay switches RL132, RL133 and RL232 contact the other fixed terminals b132, b133 and b232.

The dropping outlet. cup detecting switches SW18 and SW19 are shorted when the cold drink cup and the hot drink cup are not loaded respectively, at the dropping outlets 18 and 19. Turrets 16 and 17 are rotated when the turret motors M16 and M17, respectively, are driven.

In the explanation of the drawings, symbol ZD is constant voltage diode (zener diode), AC is alternative current power source, and Vcc is the power supply terminal.

According to the present invention, the cold drink and the hot drink cups are loaded between turret plates (16B, 16C), (16C, 16D), (16D, 16E), (17B, 17C), (17C, 17C), and (17D, 17E), of the turrets 16 and 17. At the same time, the cold drink and the hot drink cups are also loaded on the dropping outlets 18 and 19 between the turret plates (16A, 16B) and (17A, 17B). Auxiliary cup 23, that is, a cold drink cup or a hot drink cup is loaded on the auxiliary cup loading rack 20, and in this state, a cold drink cup or a hot drink cup is loaded on the dropping outlet 18 and 19 and is selectively dropped according to the purchase selection of a cold drink or a hot drink.

Here, when the cold drink is sold more frequently, moving plate 27 of the auxiliary loading rack 20 is turned clockwise, and the auxiliary cup 23 is loaded as a cold drink cup, assuming that the movable terminal of the selection switch SW40 is contacted to fixed terminal a40 in a predetermined fashion. When the dropping of the cold drink cup loaded on the dropping outlet 18 is completed, the dropping outlet cup detecting switch SW18 for detecting the cup at the dropping outlet 18 is closed, and since relay RL11 is driven, relay switch RL111 is closed, relay R12 is driven, and finally, relay switch RL121 is closed.

Thus, when relay switch RL121 is closed, capacitor C11 is charged by power supply voltage Vcc through the resistor RI, diode D1, auxiliary cup load detecting microswitch 315, relay switch RL121 and diode D11. A bias voltage is applied to the transmitter TR11. Transistor TR11 turns ON for a predetermined period of time (e.g., approximately 1 second according to the charging capacity of the capacitor C11) and relay RL13 is driven. Consequently, relay switch RL131 is opened, and the movable terminals of the relay switches RL132 and RL133 contact fixed terminals a132 and a133 respectively.

Subsequently, turret motor M16 is not driven (disengaged), and turret 16 is not turned. While current from power supply terminal Vcc flows through relay switch RL133, direct current motor 241 and relay switch RL132, the direct current motor 241 is rotated in a first or forward direction.

Thus, when the direct current motor 241 is driven in the first or forward direction, the rotary shaft 242 of the gear box 24 is turned clockwise. As shaft 26 is turned clockwise and the moving plate 27 is turned, the loaded auxiliary cup 23 (e.g., the cold drink cup) is moved toward the dropping outlet 18; at this moment, the supporting plate 222A is turned clockwise according to the movement of the auxiliary cup 23 and supports the auxiliary cup 23 so that it does not fall down.

Cams 281 and 282 rotate according to the rotation of the rotary shaft 242. Microswitch 283, with levers 283A and 284A, contacts cams 281 and 282, respectively, and thus become closed. Since the current from terminal Vcc flows through the selection switch SW40, relay RL13 and microswitch 283, the charging of the capacitor C11 is completed. Relay RL13 is then driven continuously even if the transistor TR11 turns OFF, and the auxiliary cup 23 is moved to the dropping outlet 18.

When auxiliary cup 23 is moved, the lever 313 is turned by the resilient force of the spring 312 and presses against the lever 315A of the microswitch 315 and the microswitch contacts open. Hence, the auxiliary cup 23 is completely moved to the dropping outlet 18. Detecting switch SW18 is opened and the driving of the relay RL11 is stopped. Relay switch RL111 is opened and the driving of the relay RL12 is stopped, which opens relay switch RL121. Microswitch 283 is opened in response to the completion of movements of the auxiliary cup. The driving of the relay RL13 is stopped, and the relay switch RL131 is closed. Finally, the movable terminals of the relay switches RL132, RL133 are contacted to the fixed terminals b132 and b133, respectively, and the driving of the direct current motor 241 is stopped.

When a consumer purchases the cold drink, the cup loaded on the dropping outlet 18 is dropped, and the switch SW18 is closed. Relay RL11 is driven and relay switch RL111 is closed, thus relay RL12 is driven, closing relay switch RL121. However, at this moment, since the auxiliary cup 23 is not loaded on the auxiliary cup loading rack 20 and the microswitch 315 is opened, transistor TR11 switches OFF and the relay RL13 closes. According to this sequence, the direct current motor 241 is not driven, and since the relay switch RL131 remains closed, the turret motor M16 is driven and turret 16 turned. The above sequence results in cold drink cups being loaded between each of the turret plates (16B, 16C), (16C, 16D), (16D, 16E) and sequentially dropped through outlet 18.

When dropping of a hot drink cup loaded on the dropping outlet 19 is completed, the detecting switch SW19 is closed, relay RL21 is driven and relay switch RL211 becomes closed, followed by relay RL22 being driven and relay switch RL221 closing. However, at this moment, since the movable terminal of the selecting switch SW40 is contacted to fixed terminal a40, the relay RL23 is not driven and the direct current motor 241 is OFF. Furthermore, turret motor M17 is driven, turret 17 turned, and the hot drink cups are loaded between turret plates (17B, 17C), (17C-17D), (17D, 17E) and are sequentially fed to the dropping outlet 19.

That is to say, when a cold drink cup is loaded with the auxiliary cup 23, and as soon as the dropping of the cold drink cup loaded on the dropping outlet 18 is completed, the auxiliary cup 23 is moved to the dropping outlet 18 and dropped thereafter. The cold drink cups are loaded between the turret plates (16B, 16C), (16C, 160), (16D, 16E), and are sequentially moved to the dropping outlet 18 to be dropped. When the dropping of a hot drink cup loaded on the dropping outlet 19 is completed, the hot drink cups loaded between the turret plates (17B, 17C), (17C, 17D), (17D, 17E), are sequentially moved to the dropping outlet 19 and are dropped.

On the other hand, when the hot drink is frequently sold, the moving plate 27 of the auxiliary cup loading rack 20 is turned to the cold drink cup loading means 17 and the hot drink cup is loaded for the auxiliary cup 23. Assuming that the movable terminal of the selecting switch SW40 is contacted to the other side fixed terminal b40 in a predetermined fashion, the dropping of the hot drink cup loaded on the dropping outlet 19 is completed. Subsequently, the dropping outlet detecting switch SW19 is closed and the relay RL21 driven; the relay switch RL211 is closed and the relay RL22 driven; and finally, relay switch RL221 is closed.

Thus, capacitor C21 is charged from Vcc when the relay switch RL221 is closed. Relay switch RL231 opens, and the movable terminal of the relay switch RL232 is contacted to fixed terminal a232. The power of the power supply terminal Vcc flows through the relay switch RL232, direct current motor 241 and the relay switch RL133, thus, and the direct current motor 241 is driven in a second or reverse direction.

When the direct current motor 241 is driven in the second or reverse direction, moving plate 27 turns counterclockwise and the loaded auxiliary cup 23 (e.g., the hot drink cup) is moved to the dropping outlet; and the supporting plate 222 is turned counterclockwise according to the moving of the auxiliary cup 23 and henceforth supports the cup. Cams 281 and 282 are turned according to the driving of the direct current motor and the microswitches 283 and 284 close. Thus, relay RL23 is continuously driven even if the transistor TR21 turns OFF, and the auxiliary cup 23 moves to the dropping outlet 18.

When the auxiliary cup 23 is completely positioned to the dropping outlet 19, microswitch 315 is opened, and the detecting switch SW19, for detecting the cup at the dropping outlet 19, is opened. The driving of the relay RL21 is stopped, the relay switch RL211 is opened, and the driving of the relay RL22 is stopped. The relay switch RL221 is opened, and the microswitch 284 is opened according to the completion of movement of the auxiliary cup 23, the driving of the relay RL23 is stopped and the relay switch RL231 is closed. Thus, the movable terminal of the relay switch RL232 contact fixed terminal b232 and the direct current motor 241 is stopped.

Dropping of the cup loaded on the dropping outlet 19 is completed again: switch SW19 is closed; the relay RL21 is driven; the relay switch RL211 is closed; relay RL22 is driven; and the relay switch RL221 is closed. At this instant, since the auxiliary cup 23 is not loaded on the auxiliary cup loading rack 20 and the microswitch 315 is opened, both transistor TR21 and relay RL23 are turned OFF. The direct current motor 241 is not driven, and since the relay switch RL231 continues to keep the closed state and the turret motor M17 is driven, the turret 17 is turned and the hot drink cups loaded between each turret plate set (17B, 17C), (17C, 17D), (17D, 17E) are sequentially moved to the dropping outlet 19.

When dropping of the cold drink cup loaded on the dropping outlet 18 is completed, detecting switch SW18 is closed, relay R11 is driven and relay switch RL111 is closed; relay RL12 is driven; and the relay switch RL121 is closed. Since the movable terminal of the selecting switch SW40 is contacted to fixed terminal b40, relay RL13 is not driven and the direct current motor 241 is OFF. Relay switch RL131 remains closed and the turret motor M16 is driven. When the turret 16 is turned and the hot drink cup is loaded by each turret plate (16B, 16C) (e.g., by the auxiliary cup 23, as soon as the dropping of the cold drink cup loaded on the dropping outlet 19 is completed), the auxiliary cup 23 is moved to the dropping outlet 19 and is dropped. Thereafter, the hot drink cups are loaded between the turret plates (17B, 17C), (17C, 17D), (17D, 17E), and are sequentially moved to the dropping outlet 19 and then dropped. When the dropping of the hot drink cup loaded on the dropping outlet 18 is completed, the hot drink cups loaded between the turret plates (16B, 16C), (16C, 16D), (16D, 16E), and are sequentially moved to the dropping outlet 19 and are dropped.

As described in detail above, according to the present invention, the auxiliary cup loading rack is formed at the cup dispenser. The most frequently sold drink is loaded and thereafter moved to the dropping outlet and eventually dropped. This results in higher drink sales.

It will be appreciated that the present invention is not restricted to the particular embodiment that have been described herein. Variations and modifications may be made without departing from the spirit and scope of the invention as defined in the appended claims and equivalents thereof.

What is claimed is:

1. A cup dispenser control circuit comprising:

(a) first and second dropping outlet detecting means located adjacent first and second dropping outlets, respectively, for detecting and outputting positioning control signals in response to a loading of at least one of a first and second drink cup type on said first and second dropping outlets;

(b) first control means for rotating first and second turrets in accordance with said positioning control signals of said first and second dropping outlet detecting means when one of said first or second drink cup types is not loaded on its respective dropping outlet;

(c) auxiliary cup moving means for moving at least one auxiliary cup, having an initial position between said first and second dropping outlets, to at least one of said first and second dropping outlets in response to further positioning control signals;

(d) means for detecting whether auxiliary cups are loaded; and (e) second control means for disengaging said first and second turrets, respectively, by supplying disengage control signals to said first control means when no auxiliary cups are loaded, wherein said second control means generates said further positioning control signals in response to a selection switch indicating the selection between different drink cup types according to consumer drink demands.

2. A cup dispenser comprising:

a first drink cup loading means and a second drink cup loading means for separately loading drink cups, said first and second drink cup loading means including first and second dropping outlets, respectively;

a first drink cup feeding turret and a second drink cup feeding turret mounted within said first and second loading means;

at least one auxiliary cup;

an auxiliary cup loading rack positioned between said first and second drink cup loading means;

further loading means capable of selectively loading said at least one auxiliary cup selected from at least one of a first drink cup type or a second drink cup type;

auxiliary cup moving means capable of selectively moving said at least one auxiliary cup to at least one of said first and second dropping outlets;

auxiliary cup moving completion detecting means for detecting whether said at least one auxiliary cup has been moved to said first dropping outlet location or said second dropping outlet location; and auxiliary cup load detecting means for checking whether said at least one auxiliary cup is available for loading.

* * * * *